United States Patent [19]

Bubien

[11] Patent Number: 4,897,892

[45] Date of Patent: Feb. 6, 1990

[54] GOLF CLUB GRIP CLEANER

[76] Inventor: James K. Bubien, 2505 Elizabeth Dr., Helena, Ala. 35080

[21] Appl. No.: 294,653

[22] Filed: Jan. 9, 1989

[51] Int. Cl.[4] ..... A63B 57/00; A46B 13/04

[52] U.S. Cl. ..... 15/21 C; 15/21 R; 15/69

[58] Field of Search ..... 15/21 R, 21 C, 21 D, 15/21 E, 56, 65, 67, 69, 75, 76, 88, 101

[56] References Cited

U.S. PATENT DOCUMENTS 852,670 5/1907 Muller ..... 15/69

4,554,696 11/1985 Nye, Jr. ..... 15/76

*Primary Examiner*—Edward L. Roberts

*Attorney, Agent, or Firm*—Ashen Golant Martin & Seldon

[57] ABSTRACT

A golf club grip cleaner (10) is provided, which comprises (a) a cleaning housing (12) provided with a rotatably mounted cleaning tubular chamber (22) sealed at its bottom end with a cap (30), the tubular means provided with a plurality of cleaning brushes (26) mounted on the inside surrface thereof; (b) a power transducer housing (14) provided with a water inlet (32) and a water outlet (34) and a waterwheel (48) mounted on a shaft (52), the waterwheel activated by the flow of water introduced at the water inlet means; (c) a support platform (16) for supporting the cleaning housing above the power transducer housing; and a universal coupling joint (56) for translating the flow of water past the waterwheel to the cleaning tubular chamber. The cleaner permits the efficient and rapid cleaning of golf club grips.

11 Claims, 2 Drawing Sheets

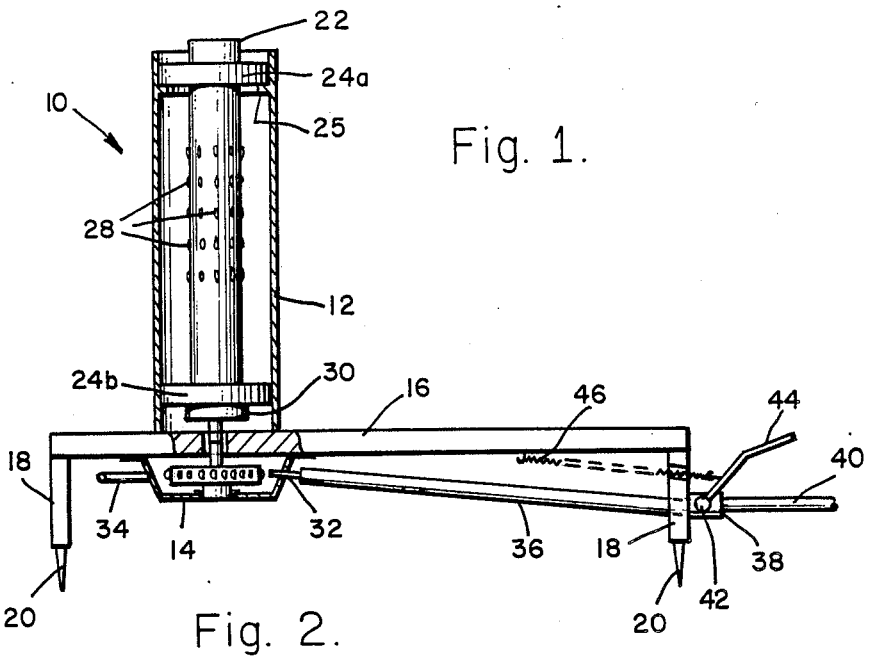
Fig. 1.
Fig. 2.
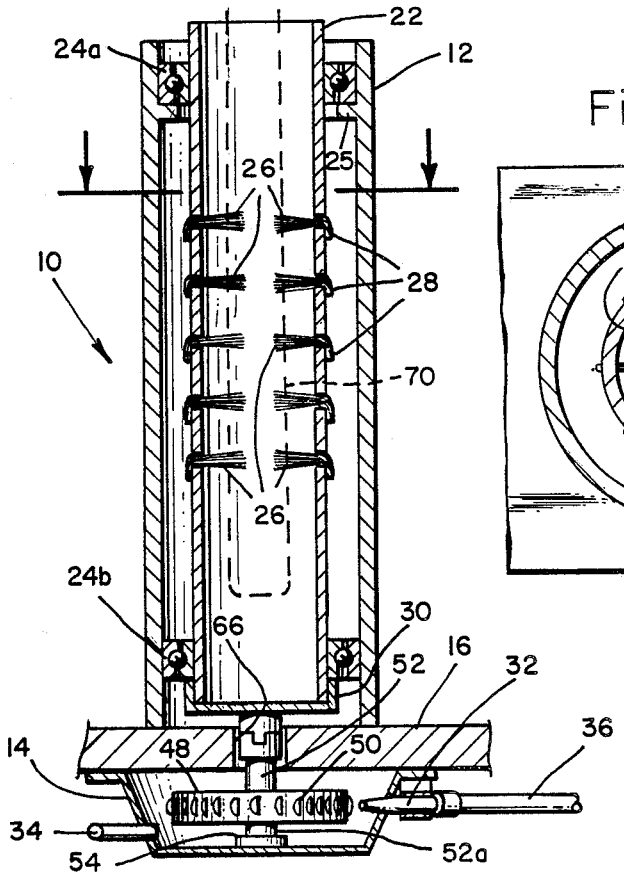
Fig. 3.
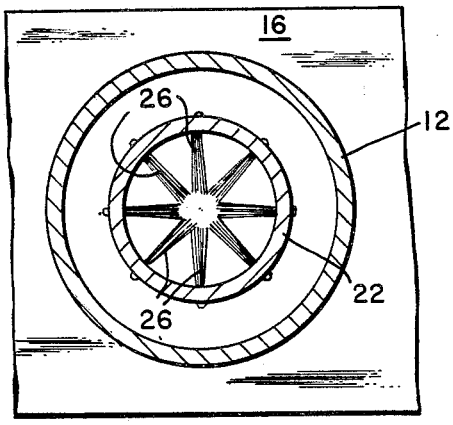

GOLF CLUB GRIP CLEANER

TECHNICAL FIELD

The present invention relates generally to golf clubs and cleaners, and, more particularly, to a cleaner for golf club grips.

BACKGROUND ART

Hitting a golf ball properly requires that the golfer be able to grip the club securely, but not squeeze it. To accomplish this, rubberized grips have been developed which provide high friction between the grip and the hands. However, during routine playing, the hands perspire. Eventually, the golf club grips become "lubricated", thereby defeating their purpose.

This problem can be overcome by simple washing of the grips. Washing with soap and water removes the dirt and grease that accumulates on the grip, and restores the original high friction between the grip and the hands.

Currently, washing golf club grips is done manually. The grip end of the club is placed in a bucket of soapy water, brushed vigorously, rinsed in fresh water, and dried.

There remains a need to provide a grip cleaner that refurbishes golf club grips automatically, to make the task of cleaning the grips easier and faster.

DISCLOSURE OF INVENTION

In accordance with the invention, a golf club grip cleaner is provided. The cleaner comprises two hollow tubes, one inside of the other. The inner tube is sealed at one end (to hold a soapy water solution). The inner tube is rotatably supported within the outer tube. The inner tube is provided with a plurality of cleaning brushes mounted on the inside wall thereof. The cleaner further comprises a power transducer unit, which is connected to the inner tube. Power is supplied to the cleaner as water pressure, such as delivered from a conventional garden hose. The power is transduced by a waterwheel and gear arrangement. The power transducer components are mounted and housed within a sealed compartment with a water ingress means and a water egress means. A valve associated with the water ingress means may be utilized to control the inflow of water, thereby acting as an on-off switch.

Cleaning of golf club grips is achieved by introducing soapy water into the interior of the inner tube, introducing a flow of water into the power transducer compartment to spin the inner tube, and inserting the grip portion of the golf club down into the inner tube for a period of time sufficient for the brushes to scrub and clean the grip. Use of the cleaner of the invention permits fast and efficient cleaning of grips.

BRIEF DESCRIPTION OF THE DRAWINGS

FIG. 1 is a side elevational view, partly in cross-section, depicting the golf club grip cleaner of the invention;

FIG. 2 is a cross-sectional view of a portion of FIG. 1;

FIG. 3 is a cross-sectional view taken along the lines 3—3 of FIG. 2;

BEST MODES FOR CARRYING OUT THE INVENTION

Figure 4:
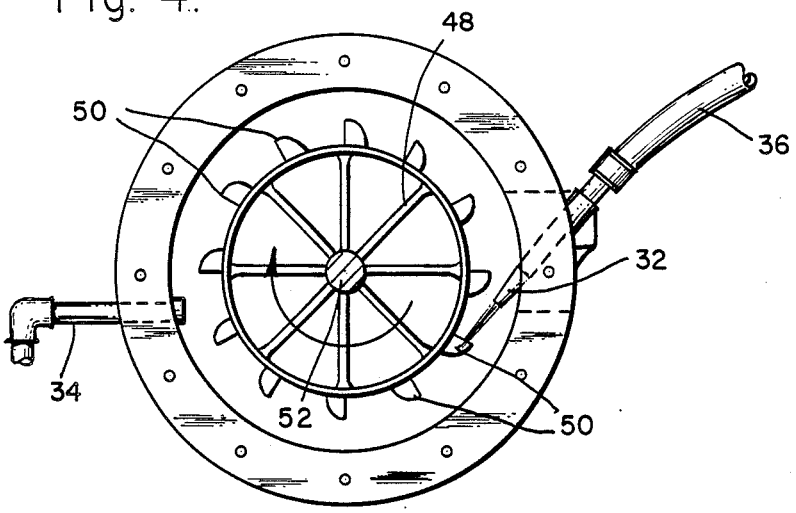
FIG. 4 is a top plan view of the water raceway; depicting egress and exiting of water by means of a turbine or paddle wheel.

Referring now to the drawings wherein like numerals of reference designate like elements throughout, a golf grip cleaner is shown generally at 10. The golf grip cleaner comprises two housings 12, 14. Top housing 12 relates to the cleaning aspect and is denoted the cleaning housing. Bottom housing 14 relates to the water activation of the unit 10 and is denoted the power transducer housing. The two housings 12 and 14 are supported by a platform 16, which is supported on legs 18 to maintain clearance between the water raceway housing 14 and the ground. For convenience, spikes 20, mounted on legs 18, are provided for driving into the ground, thereby affording stability of the cleaner 10 during the cleaning operation.

The top housing 12 includes a tubular cleaning chamber 22, which is rotatably mounted therein by roller bearings 24. Advantageously, one set of roller bearings **24*a* is provided near the top of the cleaning chamber and another set 24*b* is provided near the bottom of the cleaning chamber. The upper set of bearings 24*a* is supported on an annular shelf 25**.

The interior of the cleaning chamber 22 is lined with a plurality of cleaning brushes 26, having a sufficient stiffness to clean the grips. For example, brushes having a stiffness similar to that of brushes used in toothbrushes are suitably employed in the practice of the invention.

Advantageously, a group of the cleaning brushes 26 is arranged in a star pattern, as depicted in FIG. 3; there are a plurality of such groups of brushes along the length of the cleaning chamber 22 sufficient to encompass the length of a golf grip. Other patterns, such as a spiral arrangement of the brushes, may alternatively be employed.

The bristles of the brushes 26 are mounted on a bristle support member 28, which conveniently passes through openings in the wall of the tubular chamber 22. The bristle support members 28 are crimped against the outer wall of the tubular chamber 22, and the openings are preferably sealed against leakage of liquid from the inside of the chamber. A commercially available silicone sealer may be used, for example.

The bottom of the cleaning chamber 22 is sealed by a cap 30; this permits the cleaning chamber to be filled with a soapy water solution for cleaning the golf club grips.

The cleaning chamber 22 is sized and the extent of brushes 26 is such that the entire length of a golf club grip traverses approximately 80% of the chamber length. This avoids the possibility of jamming the end of the golf club against the cap 30. The level of the soapy water solution is conveniently approximately 80% of the height of the cleaning chamber 22.

The power transducer housing 14 is provided with water inlet means 32 and water outlet means 34, best seen in FIGS. 2 and 4. The water inlet means 32 is connected to a tube 36, the other end of which terminates in a water connector 38 for connection to a source of water (not shown). Advantageously, a quick-disconnect connector of the variety used with ordinary garden hoses may be used, since a garden hose (shown at 40) may serve as a convenient source of water. Other connectors, may, of course, be employed, such as the common threaded variety.

A foot-activated valve 42 may be used to control the flow of water entering the power transducer housing 14. In the embodiment depicted herein, a lever 44 is connected to the valve 42, such as a ball valve, within a quick-disconnect connector 38; such connectors containing such ball valves are well-known, and thus do not form a part of this invention. The lever 44 may be attached to the valve by any convenient fastening means, such as clamps or screws, use of an adhesive, and the like. A return spring 46 is provided to return the valve 42 to a normal closed position. This arrangement serves as an on-off switching device.

A waterwheel 48 is provided with a plurality of water-catching protrusions, or vanes, 50. The waterwheel 48 is positioned t be in the path of the incoming water stream from the water ingress 32 so as to catch the flow of water and rotate. In particular, the water input 32 is angled obliquely to the vanes 50 on the waterwheel 48 to maximize the conversion of water pressure to centrifugal torque. The angle of the water input 32 is approximately 45°±15°, normal to the power transducer housing 14.

The waterwheel 48 rotates on a shaft 52, the bottom portion 52*a* of which is seated in a bearing assembly 54 and the top portion of which is secured to coupling portion 56, such as by screws. The coupling portion couples the shaft 52 to a stub portion 58 provided with a spline 60 which fits in groove 62 of the coupling portion 56. The stub portion 58 is secured to the cap 30 by fastening means, such as screws. This coupling assembly 64 passes through an opening 66 in the platform 16.

Figure 5:
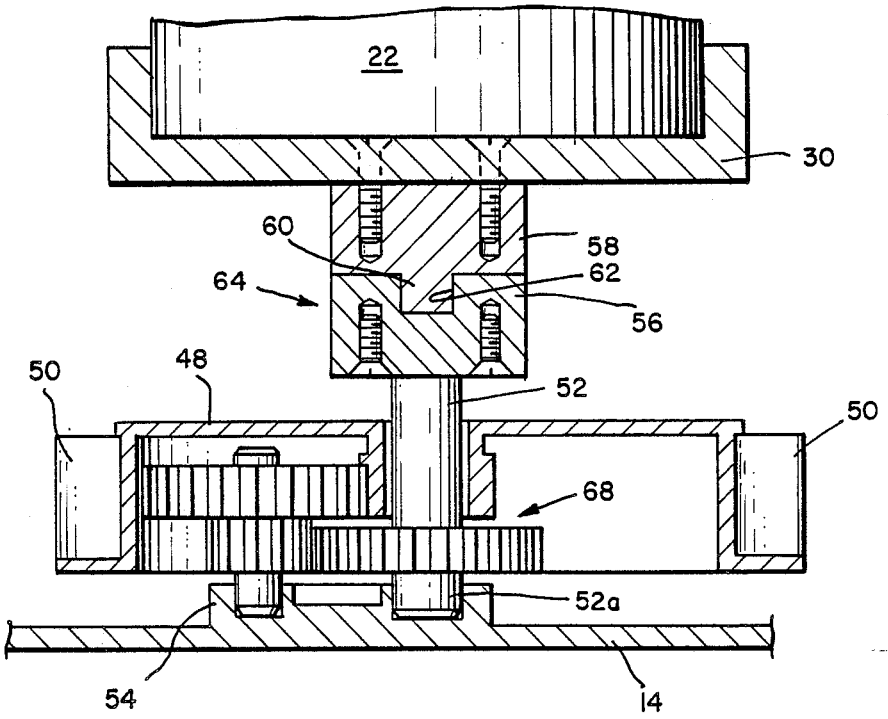
FIG. 5 is a cross-sectional view of the link between the shaft supporting the paddle wheel and the shaft supporting the hollow tube.

The waterwheel 48 is geared by means of a gear train 68 (seen in FIG. 5) to increase the revolutions per minute of the central spline 60, which is connected via the universal joint 56 to the inner tube 22. A convenient gear ratio used in the practice of the invention is 1:4 spins of the waterwheel 48 to spins of the cleaning chamber 22. By this mechanism, the inner tube, the soapy water within it, and the brushes 26 mounted on its inner wall spin to provide the means for refurbishing the golf grip.

In operation, the device 10 is set into the ground with the aid of spike 20, such as by stepping on appropriate portions of the platform 16. In this manner, the device 10 is held securely in place.

A "quick connect" 38 is mounted on the housing for connection to a garden hose 40, which is turned on. This "quick connect" allows the user to connect the hose and the device without having to screw it in. However, the "quick connect" is not essential to the invention, and may be dispensed with.

Soapy water is placed in the inner tube 22. The grip end 70 of a golf club (shown in phantom in FIG. 2), is placed vertically into the inner tube, and the user steps on the pedal or lever 44 to activate water flow through the power transducer 14. In order to ensure maximum cleaning benefits, the user must hold onto the club firmly.

While the inner tube 22 is spinning, the user moves the club 72 up and down so that all areas on the grip 68 get scrubbed by the brushes 26. After about 15 to 30 seconds, the club may be removed from the device 10, rinsed with fresh water, and allowed to dry. The procedure is repeated with each of the clubs in the set.

INDUSTRIAL APPLICABILITY

The golf club grip cleaning device 10 of the invention is expected to find use in cleaning handle grips of golf clubs.

Thus, there has been disclosed a golf club grip cleaner for cleaning the grips of golf clubs. It will be appreciated by those skilled in this art that various changes and modifications of an obvious nature may be made without departing from the spirit of the invention, and all such changes and modifications are considered to fall within the scope of the invention, as defined by the appended claims.

What is claimed is:

1. A golf club grip cleaner comprising:

(a) a cleaning housing provided with a rotatably mounted cleaning tubular means sealed at its bottom end, said tubular means provided with a plurality of cleaning brushes mounted on the inside surface thereof;

(b) a power transducer housing provided with a water inlet means and a water outlet means and a waterwheel mounted on a shaft, said waterwheel activated by the flow of water introduced at said water inlet means;

(c) a support means for supporting said cleaning housing above said power transducer housing; and (d) coupling means for connecting said waterwheel to said cleaning tubular means to rotate said cleaning tubular means.

2. The golf grip club cleaner of claim 1 wherein said cleaning tubular means is rotatably mounted in said cleaning housing by a pair of roller bearing assemblies near the top and bottom thereof.

3. The golf club grip cleaner of claim 1 wherein said cleaning brushes are arranged in a plurality of levels, with a plurality of brushes in each level arranged in a star pattern.

4. The golf club grip cleaner of claim 1 wherein said waterwheel is provided with vanes and wherein said water inlet means is angled oblique with respect to said vanes to maximize the conversion of water pressure to centrifugal torque.

5. The golf club grip cleaner of claim 1 wherein said water inlet means is provided with a valve assembly for control of water pressure for use as an on-off switching device.

6. The golf club grip cleaner of claim 5 wherein said valve assembly is provided with a foot-activated lever.

7. A golf club grip cleaner comprising:

(a) a cleaning housing provided with a rotatably mounted cleaning tubular means sealed at its bottom end, said tubular means provided with a plurality of cleaning brushes mounted on the inside surface thereof, said cleaning tubular means rotatably mounted in said cleaning housing by a pair of roller bearing assemblies near the top and bottom thereof;

(b) a power transducer housing provided with a water inlet means and a water outlet means and a waterwheel mounted on a shaft, said waterwheel activated by the flow of water introduced at said water inlet means and said water inlet means provided with a valve assembly for control of water pressure, said waterwheel provided with vanes and wherein said water inlet means is angled oblique with respect to said vanes to maximize the conversion of water pressure to centrifugal torque;

(c) a support means for supporting said cleaning housing above said power transducer housing, said support means provided with stabilizing means for anchoring said cleaner to the ground; and (d) coupling means for connecting said waterwheel to said cleaning tubular means to rotate said cleaning tubular means

8. The golf club grip cleaner of claim 7 wherein said cleaning brushes are arranged in a plurality of levels, with a plurality of brushes in each level arranged in a star pattern.

9.. The golf club grip cleaner of claim 7 wherein said valve assembly is provided with a foot-activated lever.

10. The golf club grip cleaner of claim 7 wherein said angle of said water inlet means is 45°±15° with respect to the normal to said power transducer housing.

11. The golf club grip cleaner of claim 7 wherein said waterwheel is connected to said coupling means through a gear train providing about a 1:4 gear ratio of the rotation of said waterwheel to said cleaning tubular means.

* * * * *